United States Patent [19]

Eskeli

[11] 3,972,194

[45] Aug. 3, 1976

[54] THERMODYNAMIC MACHINE OF THE VANE TYPE

[76] Inventor: Michael Eskeli, 7994-41 Locke Lee, Houston, Tex. 77042

[22] Filed: Aug. 13, 1975

[21] Appl. No.: 604,347

[52] U.S. Cl. ..... 60/650; 60/682; 60/511; 122/26; 126/247

[51] Int. Cl.[2] ..... F01K 25/00

[58] Field of Search ..... 60/511, 649, 650, 682, 60/508; 122/26; 126/247

[56] References Cited

UNITED STATES PATENTS 3,823,559 7/1974 Foret ..... 60/508

*Primary Examiner*—Allen M. Ostrager

[57] ABSTRACT

A method and apparatus for a thermodynamic machine for the generation of power or for the transport of heat, where a compressible working fluid is compressed and expanded in a cycle using a vane type apparatus. Heat is added and removed from the working fluid by using another fluid within the vane unit housing together with the working fluid. The second fluid is also circulated through external heat exchange means for changing the temperature of the fluid. The working fluid may be a suitable gas, such as a halogenated hydrocarbon or carbon dioxide, and the second fluid may be a liquid such as a light oil which also can provide lubrication within the housing. The working fluid ordinarily remains within the vane type unit housing, while the second fluid is circulated through the outside heat exchanger means.

4 Claims, 6 Drawing Figures

THERMODYNAMIC MACHINE OF THE VANE TYPE

BACKGROUND OF THE INVENTION

This invention relates generally to apparatus for generating power and for transporting heat wherein a working fluid is compressed and expanded within a vane type machine.

There have been previously vane type machines for both power generation and for heat transport, but they usually provide for entry of the working fluid into the rotor housing from external sources, and after passing through the vane unit, leaving the unit through an exit. This type operation results in a poor efficiency.

SUMMARY OF THE INVENTION

It is an object of this invention to provide a method and apparatus for the generation of power or for transmission of heat wherein a compressible working fluid is cyclically expanded and compressed, with such expansion being partially isothermal, and such compression being partially isothermal. In addition, the process for the working fluid is non-flow type. Further, a simple vane type apparatus is used, with the heat transfer fluid being in contact with the working fluid, and by using as the heat transfer fluid a light oil, lubrication of the vane unit is also provided for, if desired.

DESCRIPTION OF PREFERRED EMBODIMENTS

Figure 1:
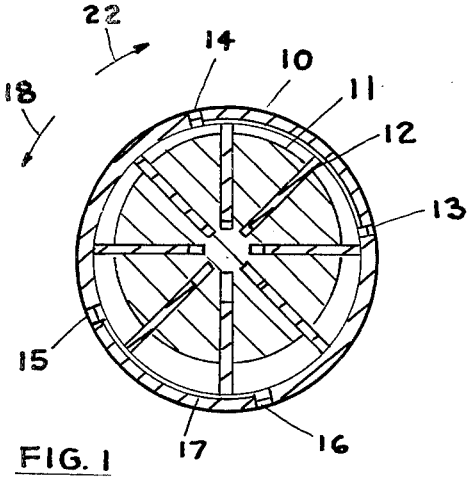
FIG. 1 is an end cross section of the unit.

Referring to FIG. 1, therein is shown a cross section of the unit transverse to the axis of rotation. 10 is housing, 11 is rotor, 12 are rotor vanes, 13 and 14 are entry and exit for hot heat transfer fluid, and 15 and 16 are entry and exit for cold heat transfer fluid, 17 are optional grooves in housing for improved heat transfer, 18 indicates direction of rotation for rotor for a typical heat intensifier application, and 22 indicates usual direction of rotation for heat engine application.

Figure 2:
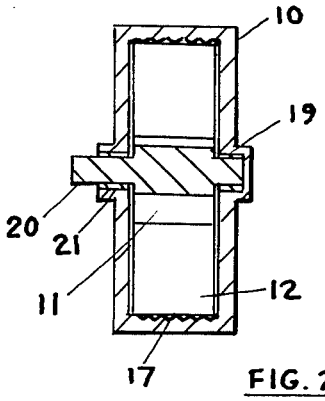
FIG. 2 is an end view of the unit.

In FIG. 2, an axial cross section is shown. 10 is casing, 11 is rotor, 19 and 21 are bearings, 20 is rotor shaft, 12 is rotor vane, and 17 are housing grooves for improved heat transfer.

Figure 3:
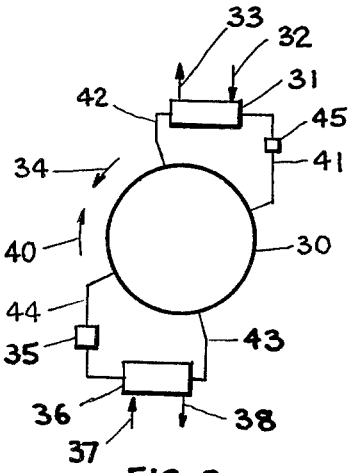
FIG. 3 is schematic diagram of a typical application of the unit.

In FIG. 3, a schematic diagram for typical application is shown. 30 is vane type unit, 31 is high temperature heat exchanger, 36 is low temperature heat exchanger, 35 is circulator for low temperature heat transfer fluid, 43 and 44 are low temperature heat transfer fluid conduits, 37 and 38 are third fluid entry and exit to low temperature heat exchanger, 41 and 42 are conduits for high temperature heat transfer fluid, 32 and 33 are entry and exit for fourth fluid into heat exchanger 31, 40 is typical direction of rotation for rotor when used for heat engine application and 34 is typical direction of rotation for heat intensifier application. 45 is an alternate location for circulator 35; also, two circulators for the heat transfer fluid may be employed, if desired.

Figure 4:
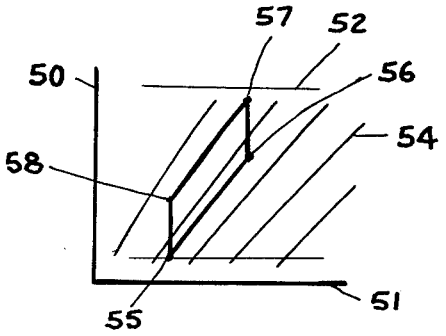
FIG. 4 is a pressure-enthalpy diagram.

In FIG. 4, a typical pressure-internal energy diagram for a working fluid is shown, with a work cycle illustrated thereon. 50 is pressure line and 51 is internal energy line, 52 is constant pressure line, and 54 is constant entropy line. The cycle for heat intensifier use is 55-56-57-58-55, and for heat engine 55-58-57-56-55.

In operation, the cavity of the unit housing is filled with a suitable compressible fluid. The rotor is caused to rotate at least initially, so that the working fluid is alternately compressed and expanded within the housing cavity. When operated as a heat intensifier, heat is removed from the working fluid into the heat transfer fluid between openings 13 and 14, while the rotor rotates in the direction indicated by 18. After expansion, and accompanying cooling of the working fluid, heat transfer fluid at a suitable temperature is injected into the housing cavity through opening 15, and then this heating fluid is discharged through opening 16. Ordinarily, the pressure of the working fluid is greater at opening area 14 than at 13, and thus the heat transfer fluid will flow propelled by this pressure differential, without additional circulator. For the heat transfer fluid flowing through openings 15 and 16, a circulator is usually required to overcome pressure differentials. The working fluid is thus cooled during compression and heated during expansion, thus leading to improved performance. Also, the working fluid is in non-flow process within the rotor.

For use as a heat engine, the rotation of the rotor is reversed to direction shown by 22, and the work cycle is also reversed.

Since the two fluids being used within the unit are normally of different density and do not dissolve to each other to any great extent, the rotation of the rotor by centrifugal force tends to push the heavier liquid fluid, which is the heat transfer fluid, toward the housing wall. To improve heat transfer, grooves are shown in the rotor housing wall as indicated by 17. In such grooves, some liquid fluid will remain, and it will then mix with the newly injected liquid fluid, thus improving heat transfer, since it is this mixture that is removed via opening 14 in the heat intensifier mode. The openings for entry of the liquid fluid into the housing cavity are usually nozzles so that liquid is sprayed in the form of a mist into the housing cavity for better heat transfer from the working fluid into the liquid fluid.

The main purpose of using a gaseous working fluid confined within the rotor housing is to provide a non-flow process condition which in turn will lead into a better efficiency for the device. The use of a liquid as the heat transfer fluid provides for an improved method of transporting the heat into and out of the working fluid, while at the same time providing a means for lubricating the housing interior where normally friction losses are high.

The unit shown herein can be used either as a heat intensifier or a heat engine. Normally, for best results, the working fluid used for a heat engine differs from the working fluid used for a heat intensifier. Usually, a fluid with a low specific heat at constant volume is desirable for a heat intensifier, while a fluid with a high specific heat value at constant volume is desirable for a heat engine. Examples are carbon dioxide for heat intensifier use and ethane for heat engine use.

Figure 5:
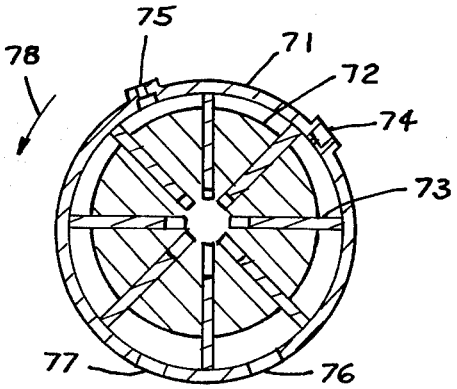
FIG. 5 is another vane unit in detail.

Referring to FIG. 5, there is shown a vane unit for mainly to be used as a heat intensifier. 71 is casing within which rotor 72 rotates and vanes 73 are rotated, 74 is liquid fluid inlet and 75 is liquid fluid outlet, 78 indicates direction of rotation of rotor, and 76 and 77 are inlet and outlet for the gaseous fluid. With this unit, the gaseous working fluid enters and leaves via said entry and exit, and to remove heat, the liquid heat transfer fluid circulates through entry 74 and out from exit 75. Entry 74 may be provided with nozzles to spray the liquid into the rotor cavity to improve mixing and heat transfer from gas to liquid.

Figure 6:
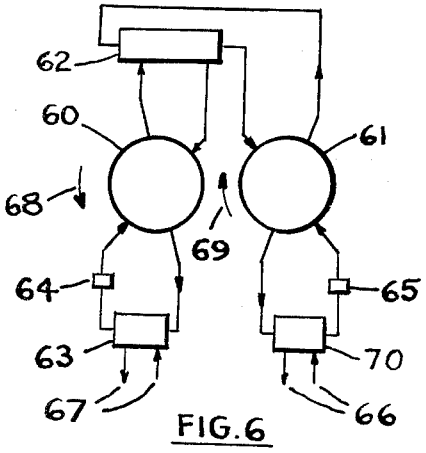
FIG. 6 is a diagram for a power generator system.

In FIG. 6, there is illustrated a system for generation of power using units of the type shown in FIG. 1, and also the unit of FIG. 5. The two units of the vane type, 60 and 61 are usually connected by a shaft, with the unit 60 being a heat intensifier supplying high temperature heat into heat exchanger 62, where the heat is transferred into another liquid fluid and transported into heat engine 61 for generation of power. 68 and 69 indicate direction of rotation, 63 is heat supply heat exchanger for the system where circulator 63 may be provided to circulate the heat transfer fluid, and 70 is cooling heat exchanger for the heat engine, where circulator 65 may be used to circulate the heat transfer fluid. Alternately, as indicated hereinbefore, the fluid being circulated through heat exchangers 63 and 70 may be the working fluids respectively for the heat intensifier and the heat engine.

When in operation, the system of FIG. 6 receives heat via heat exchanger 67, and rejects heat via heat exchanger 70. With some fluid combinations for the working fluid, the cooling fluid leaving heat exchanger 70 may be used as the heat source for heat intensifier heat exchanger 63. Such working fluid combinations may include Freon 22 as the working fluid for 60 and ethane as the working fluid for 61. Other combinations are also available. It should be also noted that normally a starter is required for the system of FIG. 6.

What is claimed is:

1. A thermodynamic machine comprising:

a. a casing supporting a rotor shaft journalled for rotation within said casing;

b. a rotor mounted on said rotor shaft so as to rotate therewith, said rotor being within said casing off center, said rotor having movable vanes with the vanes outer ends following the inner surface of said casing and providing variable volume spaces within said casing as said rotor rotates;

c. a compressible gaseous working fluid filling said casing and circulating therewithin, with said working fluid being compressed and expanded while within the variable volume spaces of said casing;

d. a heat transfer fluid being circulated within said casing to exchange heat with said working fluid, said heat transfer fluid being a liquid, with said heat transfer fluid entering said casing and leaving said casing via entry and exit ports provided in said casing.

2. The thermodynamic machine of claim 1 wherein said heat transfer fluid receives heat from said working fluid after the compression within the variable volume spaces of said casing of said working fluid, and wherein said heat transfer fluid leaves said casing via exit ports after such receiving of heat.

3. The thermodynamic machine of claim 1 wherein said heat transfer fluid delivers heat into said working fluid after the compression of said working fluid within the variable volume spaces of said casing, and wherein said heat transfer fluid leaves said casing via exit ports after such delivery of heat.

4. In a method of generating power wherein a vane type heat pump and a vane type heat engine are used, with said heat pump employing a first working fluid, and and said heat engine employing a second working fluid, the improvement comprising:

a. transferring heat from said first working fluid into a heat transfer fluid within the casing of said heat pump, with said first working fluid being a gas, and the heat transfer fluid being a liquid, with the heat transfer being provided after compression of said first working fluid;

b. transferring the heat from the heat transfer fluid into said second working fluid in said heat engine casing, with the heat transfer being provided from the heat transfer fluid into said second working fluid after compression of said second working fluid, with the heat being transferred into said second working fluid being the heat provided by said heat pump.

* * * * *